US005894669A

United States Patent [19]

Lüttgens

[11] Patent Number: 5,894,669

[45] Date of Patent: Apr. 20, 1999

[54] SHARPENER FOR SOFT CORE PENCILS

[75] Inventor: Fritz Lüttgens, Erlangen, Germany

[73] Assignee: KUM GmbH & Co., Kunststoff- und Metallwarenfabrik, Erlangen, Germany

[21] Appl. No.: 08/923,581

[22] Filed: Sep. 4, 1997

[30] Foreign Application Priority Data

Sep. 7, 1996 [DE] Germany ..... 196 36 438

[51] Int. Cl.[6] ..... B43L 23/08

[52] U.S. Cl. ..... 30/452; 30/454; 30/457; 144/28.11

[58] Field of Search ..... 144/28.1, 28.11, 144/28.2; 30/451, 452, 453, 454, 456, 457, 459

[56] References Cited

U.S. PATENT DOCUMENTS

| | | | |
|---|---|---|---|
| 2,106,963 | 2/1938 | Ullman | 30/454 |
| 2,366,928 | 1/1945 | Paschell | 30/457 |
| 4,248,283 | 2/1981 | Kaye | 30/454 |
| 5,046,876 | 9/1991 | Boraca | 30/457 |
| 5,167,071 | 12/1992 | Eisen | 30/452 |
| 5,699,620 | 12/1997 | Hadtke et al. | 30/452 |

FOREIGN PATENT DOCUMENTS

| | | |
|---|---|---|
| 1 268 019 | 5/1968 | Germany . |
| 38 24 883 | 2/1990 | Germany . |

*Primary Examiner*—W. Donald Bray
*Attorney, Agent, or Firm*—Venable; Gabor J. Kelemen

[57] ABSTRACT

A pencil sharpener for a soft core pencil includes a sharpener housing defining a guide channel adapted to receive a front region of the pencil therein and conically tapering in an insertion direction of the pencil, and a free space adjoining the guide channel in the insertion direction and being adapted to receive a core tip of the pencil therein. The sharpener further includes a sharpener blade disposed within the housing and positioned tangentially with respect to the guide channel, and a housing projection disposed in the housing and projecting into the free space and being configured for shaping the core tip of the pencil according to an intended shape. The housing projection comprises a shaving rib having an approximately wedge shaped cross section and projecting from the housing projection in an effective direction essentially tangential to a circumference of the core tip and being configured as a generatrix for the intended shape of the core tip.

10 Claims, 2 Drawing Sheets

SHARPENER FOR SOFT CORE PENCILS

CROSS REFERENCE TO RELATED APPLICATION

This application claims the priority of German Application No. 196 36 438.8 filed Sep. 7, 1996, which is incorporated herein by reference.

FIELD OF THE INVENTION

The invention pertains to a sharpener for soft core pencils, such as cosmetic pencils.

BACKGROUND OF THE INVENTION

A sharpener of the above kind is described, for example, in DE 38 24 883, and comprises a sharpener housing generally molded as a one-piece unit and made of a plastic material. The sharpener housing defines a guide channel for receiving a front end of the pencil therein, which channel tapers conically in an insertion direction of the pencil. A sharpener blade is held in the sharpener housing and is disposed so as to be tangential with respect to the guide channel. The sharpener housing further defines a free space therein in the insertion direction of the pencil, the free space adjoining the guide channel for receiving a core tip of the pencil therein. In a sharpener of the aforementioned kind, the free space is open toward a top and a bottom of the housing, the free space being further limited by a stick-type shaping cutter having a bow-shaped blade and further defining a triangular cross section which, together with the open configuration of the free space at the top and bottom of the housing, is intended to allow a regular cutting of the core for shaping the same while avoiding scrape-offs. The free space is particularly intended to prevent the cuttings from being acted upon by the sharpener blade in order to avoid smearing of the cuttings in the case of a pile-up resulting from the problematic soft consistency of the core material.

The above configuration, however, disadvantageously leads to a low inherent stability or a low resistance to deformation of the stick-type shaping cutter. As a result of the above, given the varying degrees of softness of the cores used in known cosmetic pencils, the shaping cutter described above tends to sometimes scrape the cores instead of cutting the same. However, cutting is a desired step when shaping the core tip of pencils with the above shaping cutter.

In DE-B-1 236 374, a soft-core sharpener is disclosed having a shaping cutter which is used to shape the core tip of the pencil and which is configured as a narrow metal strip adapted to act upon the tip of the soft core with its arcuate front edge in a direction which is essentially at a right angle to the surface of the tip. The resulting scraping of the soft core leads to a pile-up of the soft core material in a region of the shaving edge. This pile-up causes a smearing of the groove in the sharpener base, which smearing has a negative effect on the core tip, the core tip tending to be very sensitive, particularly for cosmetic purposes.

Finally, DE-U-80 07 479 discloses a sharpening box for the truncated-cone sharpening of the lower shaft end of candles. The sharpening box is designed such that the candle base can be inserted into smaller receiving openings in candle holders, and defines a conical guide channel for the candle base which is slotted in the longitudinal direction thereof. One of the edges of the slot is configured as a shaving knife having a wedge shaped cross section in a plane perpendicular to the longitudinal axis of the guide channel. The wedge tip of the wedge shaped cross section projects as a shaver essentially tangentially into the guide channel of the sharpening box. The shaved off candle material glides along an edge of the slot and falls, without being further guided, into a receptacle at an exterior region of the channel wall. The shaping of the candle base as described above occurs in a circumferential region of the candle shaft, which region presents no space problems, contrary to the soft core tip region of a cosmetic pencil. For that reason alone, the removal of the candle material presents no particular problems.

SUMMARY OF THE INVENTION

It is an object of the invention to overcome the disadvantages associated with the prior art by providing a sharpener of the aforementioned type which ensures a substantially unproblematic removal of core shavings from a pencil even where the core tip of the pencil is shaped by being scraped. The sharpener according to the invention advantageously avoids the use of a stick-type shaping cutter (that is, a shaping cutter in the form of a stick directly attached to the housing) having a triangular cross-section, which does not generally possess the desired degree of solidity.

The above object, together with other objects to become apparent as the description progresses, are accomplished according to the invention by the provision of a pencil sharpener for a soft core pencil comprising a sharpener housing defining a guide channel adapted to receive a front region of the pencil therein and conically tapering in an insertion direction of the pencil, and a free space adjoining the guide channel in the insertion direction and being adapted to receive a core tip of the pencil therein. The sharpener further includes a sharpener blade disposed within the housing and positioned tangentially with respect to the guide channel, and a housing projection disposed in the housing and formed as a one-piece component therewith, the housing projection further projecting into the free space and being configured for shaping the core tip of the pencil according to an intended shape. The housing projection comprises a shaving rib having an approximately wedge shaped cross section in a plane perpendicular to a longitudinal axis of the guide channel, the shaving rib projecting from the housing projection in an effective direction essentially tangential to a circumference of the core tip and being configured as a generatrix for the intended shape of the core tip.

According to the invention, the wedge shaped form of the shaving rib which acts tangentially upon the circumference of the core tip, has a maximum wedge angle of about 70° and preferably 45°, and an effective shaving angle for the shaver of approximately at least 20°, and preferably of approximately at least 45°. The above configuration causes the shaved off core material to be lifted off the core surface of the tip of the pencil as an essentially unbroken shaving with only a slight deflection or bend, initially in approximately a tangential direction with respect to a surface of the core tip. The configuration of the shaver further causes the unbroken shaving to be bent only slightly by a shaving surface of the shaving rib within the aforementioned shaving angle, which nevertheless results in the unbroken shaving being lifted off the shaving surface only a short distance from the shaving edge of the shaving rib. The shaving maintains its internal cohesiveness in the manner of a lamella or continuous chip, and does not collide with the housing projection until it reaches a location disposed at a relatively large distance from the shaving rib and, in particular, from the shaving surface thereof. The unbroken shaving, by virtue of its consistency, has a tendency to be further bent in the removal direction instead of piling up or smearing on the shaving surface. As a result, no free space is needed for an unhindered removal of the shaving. Rather, it is advantageous that at a relatively larger distance from the shaving rib the housing projection, which includes the shaving rib thereon, serves for forming or guiding the shaving for the purpose of controlling its direction. It is particularly advantageous if the shaving is bent in a direction approximately parallel to a longitudinal axis of the pencil and pointing away from the core tip as well as the pencil as a whole. For the above purpose, a guide rib may be disposed to protrude from the surface of the housing projection.

BRIEF DESCRIPTION OF THE DRAWINGS

The foregoing objects of the invention, together with other objects and advantages which may be attained by its use, will become more apparent upon reading the following detailed description of the invention taken in conjunction with the drawings. In the drawings, where like reference numerals identify corresponding components.

DETAILED DESCRIPTION OF THE INVENTION

Figure 2:
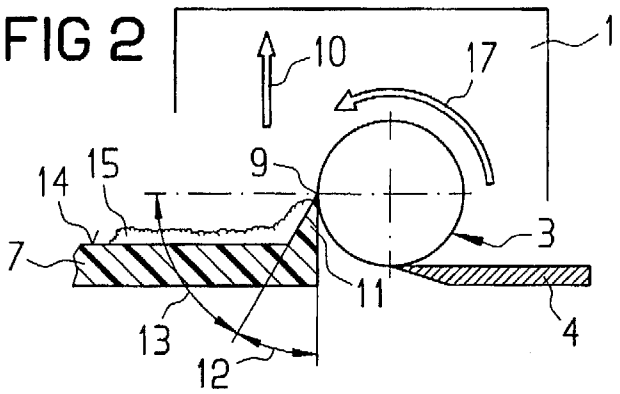
FIG. 2 is a diagrammatic, cross-sectional view through the sharpener according to FIG. 1 taken along lines II—II.
Figure 1:
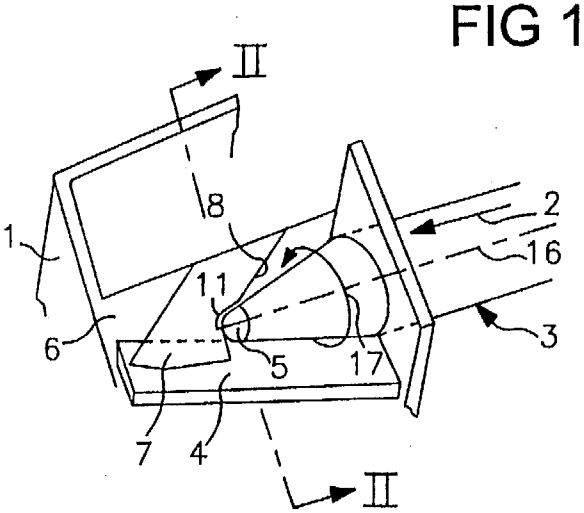
FIG. 1 is a diagrammatic, partially sectional, perspective view of a first embodiment of a sharpener according to the invention.
Figure 7:
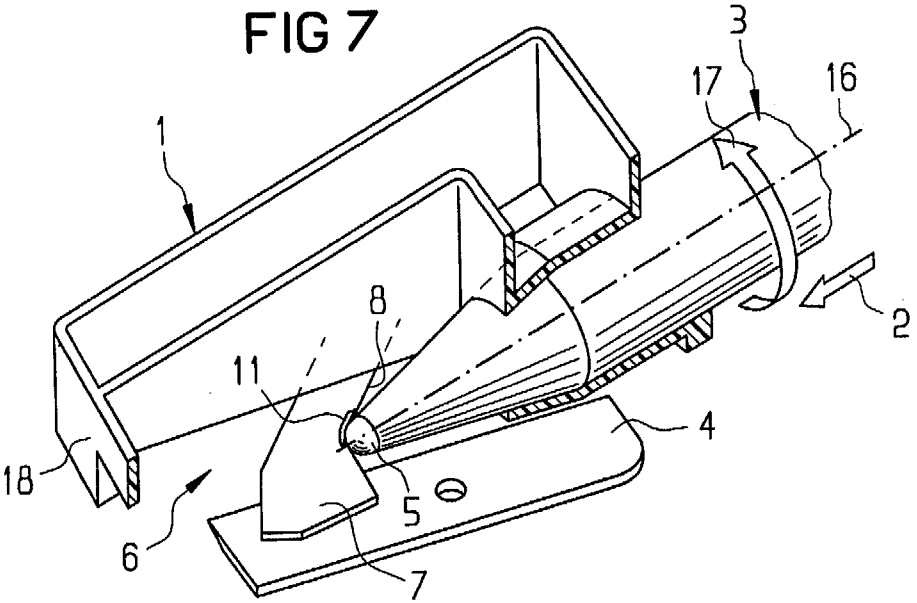
FIG. 7 is a perspective view of the sharpener according to FIG. 1.

Referring to FIGS. 1 and 7, the sharpener according to the instant invention essentially comprises a sharpener housing 1 defining a guide channel for receiving the front end of pencil 3 therein, the channel tapering conically in insertion direction 2. As seen in FIG. 2, a sharpener blade 4 is held in the sharpener housing and is disposed so as to be tangential with respect to the guide channel. Since the object of the instant description concerns primarily a shaping of core tip 5 of pencil 3, no further details are provided herein regarding the structure and/or arrangement of sharpener blade 4. The sharpener housing further defines a free space 6 therein in the insertion direction 2 of pencil 3, the free space adjoining the guide channel for receiving the core tip 5 of the pencil therein.

Figure 3:
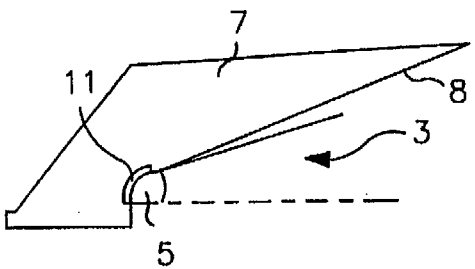
FIG. 3 is an enlarged diagrammatic top plan view of the housing projection and pencil tip according to FIG. 1.

In the embodiments of FIGS. 1–3, a one-piece housing projection 7 projects essentially radially into free space 6. In other words, housing projection 7 is adapted to extend radially with respect to pencil 3 when pencil 3 is inserted into the guide channel of the sharpener housing. Housing projection 7 serves as a template for shaping core tip 5 in an intended or predetermined manner. Thus, at an edge 8 thereof, housing projection 7 includes a shaving rib 11 having an approximately wedge shaped cross section in a plane perpendicular to a longitudinal axis of the guide channel. The shaving rib 11 protrudes from housing projection 7 in an effective direction 10 which is adapted to be essentially tangential to a surface of core tip 5 when pencil 3 is inserted into the guide channel. The effective direction is defined as the direction of a surface of the wedge shaped cross section adapted to be disposed closest to the core tip when the pencil is inserted into the guide channel. Shaving rib 11 serves as a generatrix for shaping core tip 5 by defining an outline which conforms to an intended shape of the core tip. A wedge angle 12 of the shaver is approximately $\leqq 70°$, and preferably $\leqq 45°$. The wedge angle is defined between surfaces of the wedge shaped cross section having a shaving wedge 9 at their apex. As a result of the above configuration, shaving rib 11 has a shaving angle 13 of approximately $\geqq 20°$, and preferably $\geqq 45°$. The shaving angle is defined between a surface of the wedge shaped cross section adapted to be disposed furthest from core tip 5 and the horizontal when the pencil is inserted into the guide channel. Top surface 14 of housing projection 7 supports shaving rib 11 and is configured as a shaper and/or guide for the continuous chip 15. Top surface 14 may be configured to define a hollow which is adapted to extend radially with respect to the longitudinal axis of the guide channel in a direction toward the periphery of sharpener housing 1, and/or in the insertion direction 2. Rotation arrow 17 designates the rotational sharpening direction of pencil 3.

Figure 4:
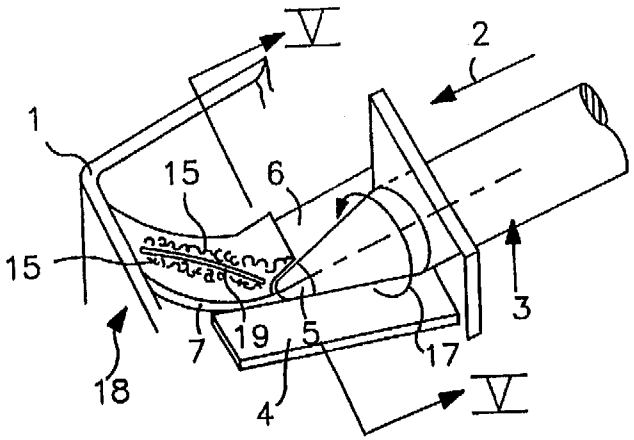
FIG. 4 is a view similar to FIG. 1 showing a second embodiment of a sharpener according to the invention.
Figure 6:
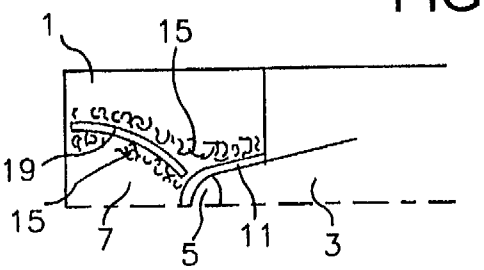
FIG. 6 is a view similar to FIG. 3 showing a top plan view of the housing projection and pencil tip according to FIG. 4.
Figure 5:
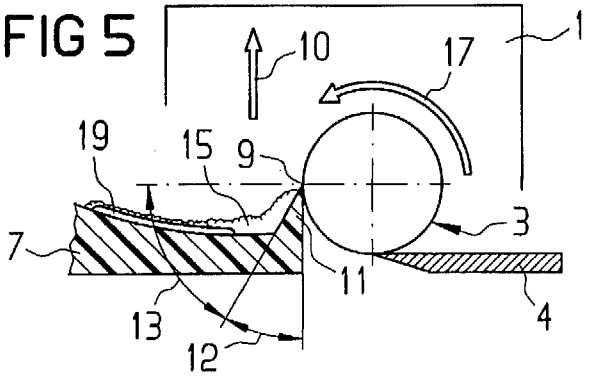
FIG. 5 is a view similar to FIG. 2 taken through the sharpener according to FIG. 4 taken along lines V—V.

In the embodiment according to FIGS. 4–6, housing projection 7 projects into free space 6 in a direction of the longitudinal axis of the guide channel and counter to insertion direction 2, from a top 18 of a side wall of the sharpener housing. Housing projection 7 is further adapted to extend toward core tip 5 of pencil 3 when the pencil is inserted into the guide channel, and is configured as a flat, sheet-like housing section. The bend in housing projection 7 defines a hollow which has a function similar to the hollow described in relation to the embodiment of FIGS. 1–3 above. Housing projection 7 further has a guide rib 19 on a top surface thereof for forming a continuous chip 15.

In the above embodiments, sharpener housing 1 can additionally include a cleaning stick for removing shaving that may still cling despite the advantageous removal effect brought about by continuous chip 15.

The invention now being fully described, it will be apparent to one of ordinary skill in the art that any changes and modifications can be made thereto without departing from the spirit or scope of the invention as set forth in the appended claims.

What is claimed is:

1. A pencil sharpener for a soft core pencil comprising:

a sharpener housing defining:

a guide channel adapted to receive a front region of the pencil therein and conically tapering in an insertion direction of the pencil; and a free space adjoining the guide channel in the insertion direction and being adapted to receive a core tip of the pencil therein;

a sharpener blade disposed within the housing and positioned tangentially with respect to the guide channel; and a housing projection disposed in the housing and projecting into the free space and being configured for shaping the core tip of the pencil according to an intended shape, the housing projection comprising a shaving rib having an approximately wedge shaped cross section and projecting from the housing projection in an effective direction essentially tangential to a circumference of the core tip and being configured as a generatrix for the intended shape of the core tip.

2. The sharpener according to claim 1, wherein a wedge angle of the shaving rib is ≦70°.

3. The sharpener according to claim 2, wherein the wedge angle of the shaving rib is ≦45°.

4. The sharpener according to claim 1, wherein a shaving angle of the shaving rib is ≧20°.

5. The sharpener according to claim 4, wherein the shaving angle of the shaving rib is ≧45°.

6. The sharpener according to claim 1, wherein the housing projection includes a top surface thereon from which the shaving rib projects and which is configured for at least one of shaping and guiding an unbroken shaving as a result of shaving the core tip of the pencil with the shaving rib.

7. The sharpener according to claim 1, wherein the top surface of the housing projection defines a hollow facing away from the guide channel and extending at least one of radially and parallel with respect to the longitudinal axis of the guide channel.

8. The sharpener according to claim 6, further comprising at least one guide rib on the top surface of the housing projection for guiding the unbroken shaving.

9. The sharpener according to claim 1, wherein said housing projection forms a one-piece component with said housing.

10. The sharpener according to claim 1, wherein said wedge shaped cross section lies in a plane perpendicular to a longitudinal axis of the guide channel.

* * * * *

UNITED STATES PATENT AND TRADEMARK OFFICE

CERTIFICATE OF CORRECTION

PATENT NO. : 5,894,669
DATED : April 20, 1999
INVENTOR(S) : Fritz Lüttgens

It is certified that error appears in the above-identified patent and that said Letters Patent is hereby corrected as shown below:

Title page,
Item [73], the name of the assignee should read: -- KUM GmbH & Co. KG Kunststoff- und Metallwarenfabrik --.

Signed and Sealed this

First Day of October, 2002

*Attest:*

*Attesting Officer*

JAMES E. ROGAN
*Director of the United States Patent and Trademark Office*